US007343637B2

(12) United States Patent
Lafleur

(10) Patent No.: US 7,343,637 B2
(45) Date of Patent: Mar. 18, 2008

(54) SNOW TOOL

(75) Inventor: Andre Lafleur, Boucherville (CA)

(73) Assignee: Andre Lafleur RD & D Inc., Quebec (CA)

( * ) Notice: Subject to any disclaimer, the term of this patent is extended or adjusted under 35 U.S.C. 154(b) by 381 days.

(21) Appl. No.: 10/920,042

(22) Filed: Aug. 16, 2004

(65) Prior Publication Data

US 2006/0032007 A1 Feb. 16, 2006

(51) Int. Cl.
*A47L 13/12* (2006.01)

(52) U.S. Cl. ..... 15/111; 15/105; 15/117; 15/121; 15/172

(58) Field of Classification Search ..... 15/117, 15/105, 160, 111, 172, 245, 236.02, 121, 15/114, 201, 244.2
See application file for complete search history.

(56) References Cited

U.S. PATENT DOCUMENTS

| | | | | |
|---|---|---|---|---|
| 2,614,281 | A | 10/1952 | Clark | |
| 2,741,790 | A | 4/1956 | Koehring | |
| 2,832,980 | A | 5/1958 | O'Neill | |
| 3,017,649 | A * | 1/1962 | Racicot | 15/105 |
| 3,036,322 | A | 5/1962 | Jorgensen | |
| 3,051,975 | A | 9/1962 | Schwartz | |
| 3,896,241 | A | 7/1975 | Malaspina et al. | |
| 3,987,807 | A * | 10/1976 | Varnell | 135/66 |
| 4,041,564 | A | 8/1977 | Schlicher | |
| 4,908,900 | A | 3/1990 | McLaughlin | |
| 2003/0146632 | A1* | 8/2003 | Marion et al. | 294/51 |
| 2005/0118345 | A1* | 6/2005 | Burghoffer | 427/429 |

FOREIGN PATENT DOCUMENTS

| | | |
|---|---|---|
| CA | 273769 | 9/1927 |
| CA | 614118 | 2/1961 |
| CA | 1158007 | 12/1983 |

* cited by examiner

*Primary Examiner*—Shay Karls
(74) *Attorney, Agent, or Firm*—Darby & Darby PC

(57) ABSTRACT

A snow tool for removing snow from vehicles having a telescopic handle and a brush disposable either longitudinally or transversally. The telescopic handle has first and second members connected in a sliding relationship and providing retracted and extended states of the handle. The snow tool has a pair of arms provided with bristles and movable between a closed position where the arms extend along the handle and an open position where the arms extend transversally thereto. The snow tool is provided with a compression spring for urging the first and second members into the extended state, and first and second locking devices for locking the first and second members with respect to each other in the retracted state and in the extended state respectively. The snow tool also has third and fourth locking devices for locking the arms in the open position and in the closed position respectively.

10 Claims, 15 Drawing Sheets

C-C

B-B

SNOW TOOL

FIELD OF THE INVENTION

The present invention generally relates to a snow tool for the removal of snow and ice from vehicles such as cars in the winter and more particularly concerns a snow tool having a telescopic handle and a brush disposable either longitudinally or transversally.

BACKGROUND OF THE INVENTION

It is frequently necessary to remove ice and snow accumulated on vehicles. In most instances, it is desirable to provide a long handle for facilitating the removal of snow. A device having a handle of proper length, however, may be difficult to store conveniently in the car.

Known in the art, there are U.S. Pat. Nos. 3,036,322, 3,017,649, 3,896,241 and 3,051,975 relating to snow and ice removal equipment combining brushes with scraper in various configurations including extensible handle portions and collapsible designs for easy storage.

Also known in the art, there are U.S. Pat. No. 2,832,980 relating to a bladed instrument where the single blade is foldable from a parallel to a perpendicular position, and U.S. Pat. No. 4,041,564 relating to an extensible brush tool where the brush remains parallel to the handle.

Also known in the brush art, there is U.S. Pat. No. 2,614,281 showing a two-bladed V-shaped brush whose angle of operation is controllable by dual handles connected to the brushes by a complex hinge mechanism.

Also known in the art, there are the following patents which describe different collapsible cleaning tools: U.S. Pat. No. 2,741,790 and Canadian patent Nos. 614,118, 273,769 and 1,158,007.

Also known in the art, there is U.S. Pat. No. 4,908,900 describing a cleaning tool for the removal of snow having brushes which can be disposed perpendicularly or parallel to the handle. The cleaning tool is provided with a handle mounted device allowing easy interchange from one position to the other. This cleaning tool, however, is not provided with an extensible handle allowing an easier cleaning while providing a tool conveniently storable.

None of the above-mentioned patent provides a convenient snow tool having a telescopic handle and a brush disposable either longitudinally or transversally which can be easily and quickly operated while being storable in a relative compact form.

SUMMARY OF THE INVENTION

It is an object of the present invention to provide a snow tool having a telescopic handle and a brush disposable either longitudinally or transversally, which can be easily and quickly operated while being storable in a relative compact form.

Accordingly, there is provided a snow tool comprising a telescopic handle comprising first and second members connected in a sliding relationship and providing retracted and extended states of the handle. The snow tool comprises a pair of arms, each having bristles provided along the length thereof, an end of each arm being pivotally attached to the first member. The snow tool is also provided with means for moving the arms between a closed position where the arms extend along the handle and an open position where the arms extend transversally to the handle. The snow tool is also provided with first locking means for locking the first and second members with respect to each other in the retracted state and second locking means for locking the first and second members with respect to each other in the extended state. The snow tool is also provided with a compression spring for urging the first and second members into the extended state, third locking means for locking the arms in the open position and fourth locking means for locking the arms in the closed position.

BRIEF DESCRIPTION OF THE DRAWINGS

A detailed description of preferred embodiments will be given hereinbelow with reference to the following drawings, in which like numbers refer to like elements.

Figure 1:
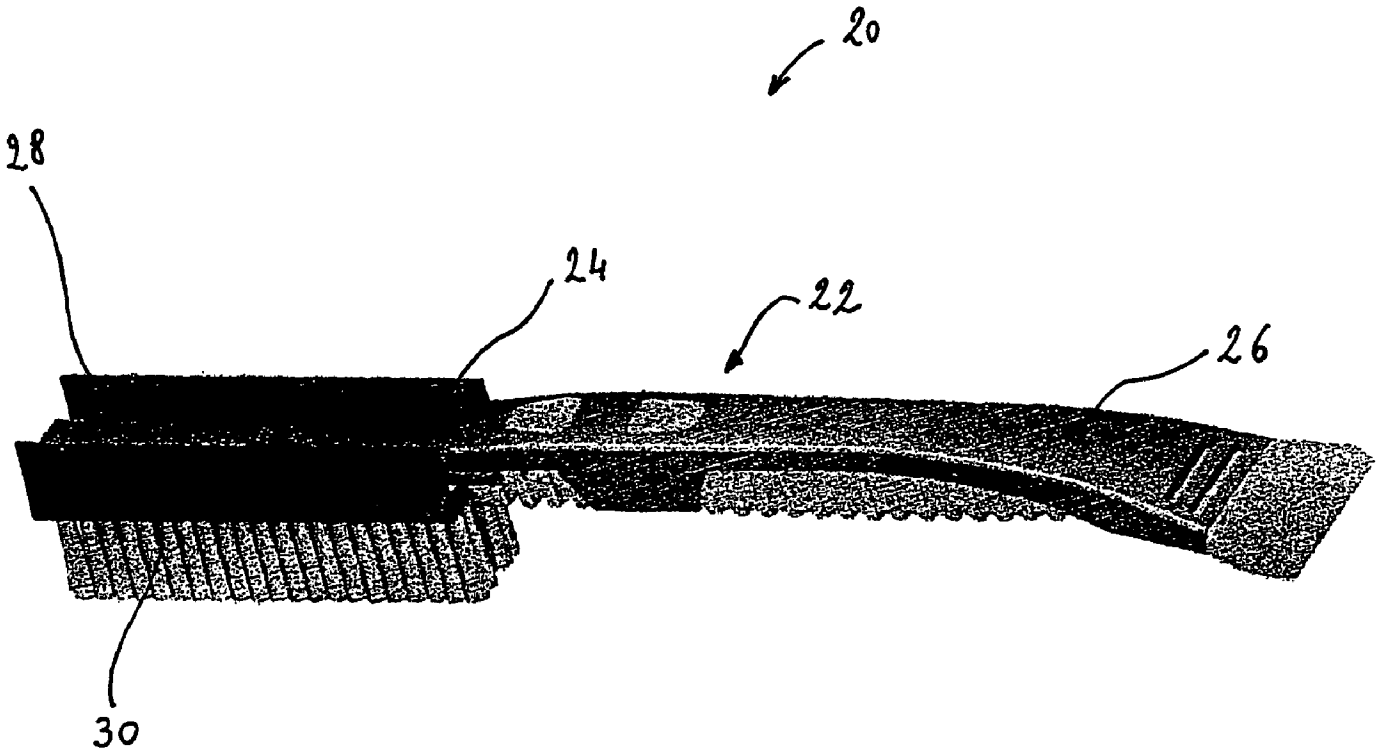
FIG. 1 is a perspective view of a snow tool in a retracted position according to the present invention.

The objects, advantages and other features of the present invention would become more apparent upon reading of the following non-restricted description of preferred embodiments thereof, given for the purpose of exemplification only with reference to the accompanying drawings.

DETAILED DESCRIPTION OF THE PREFERRED EMBODIMENTS

In the following description, similar features in the drawings have been given similar reference numerals and in order to weight down the figures, some elements are not referred to in some figures if they were already identified in a precedent figure.

The present invention concerns a snow tool which can be retracted when not in use for providing a relative compact form allowing an easier storage thereof. The snow tool is provided with a brush usable in longitudinal mode where the bristles of the brush are parallel to the brush handle or in transversal mode where the bristles of the brush are perpendicular to the brush handle. The snow tool can thus achieve the advantages of a T-shaped brush at the same time as those of a longitudinal brush. Moreover, as it will be described in more details hereinbelow, the snow tool of the present invention has means providing an automatic opening of the snow tool for offering to the user a very easy and quick operation thereof. Furthermore, the snow tool of the present invention can also be easily and quickly retracted, without the need of being dismantled. Besides, the present snow tool is simple to construct and inexpensive to manufacture.

Figure 2:
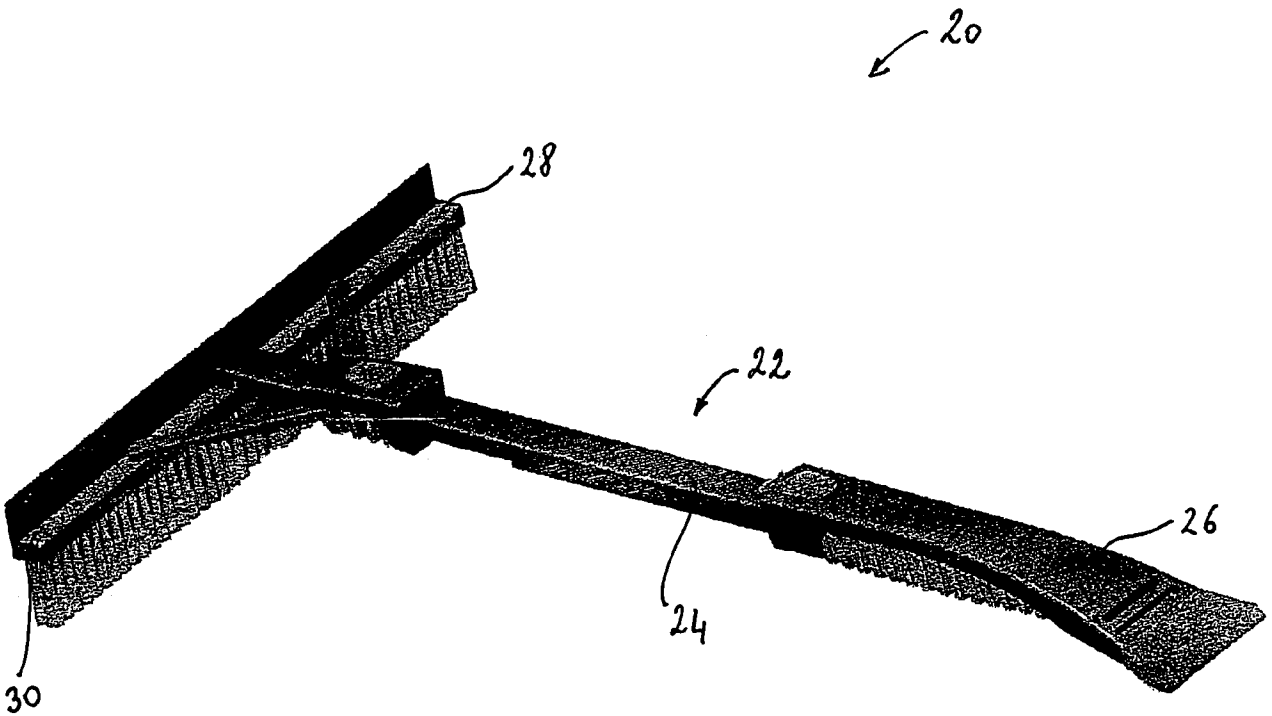
FIG. 2 is a perspective view of the snow tool of FIG. 1 in an extended position.

Referring to FIGS. 1 and 2, there is shown a snow tool 20 according to the present invention. The snow tool 20 includes a telescopic handle 22 having first and second members 24, 26 connected in a sliding relationship and providing retracted and extended states of the handle 22. FIG. 1 shows the snow tool 20 in the retracted state while FIG. 2 shows the snow tool 20 in the extended state.

Figure 3:
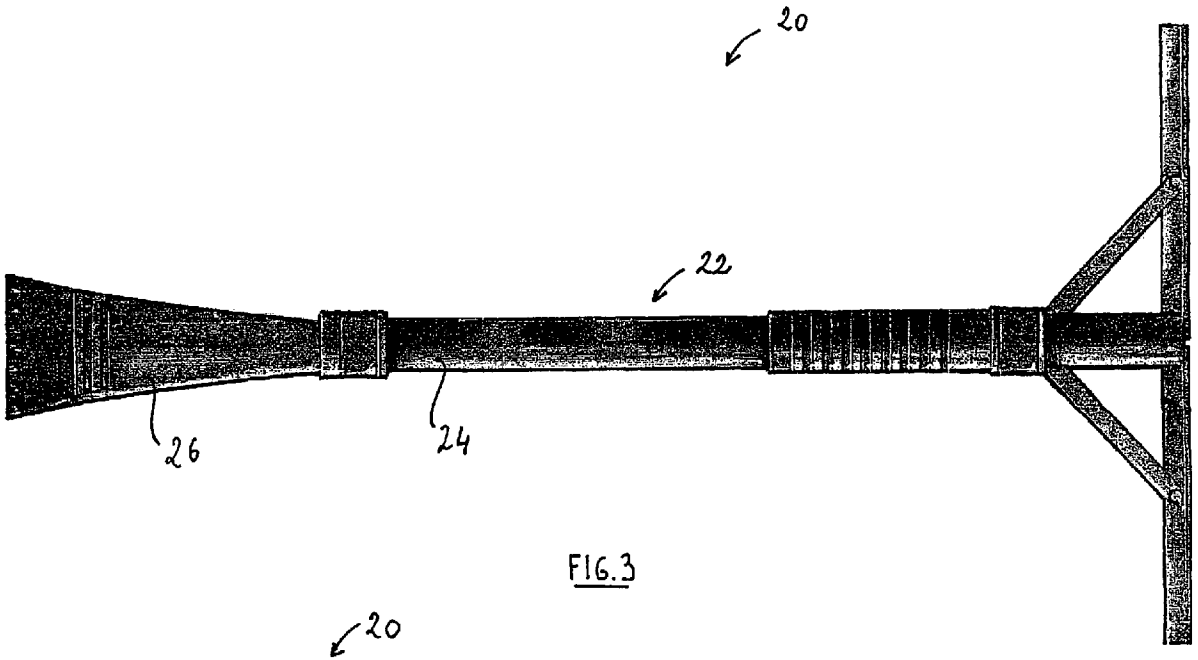
FIG. 3 is a top view of another snow tool in an extended position, according to the present invention.
Figure 4:
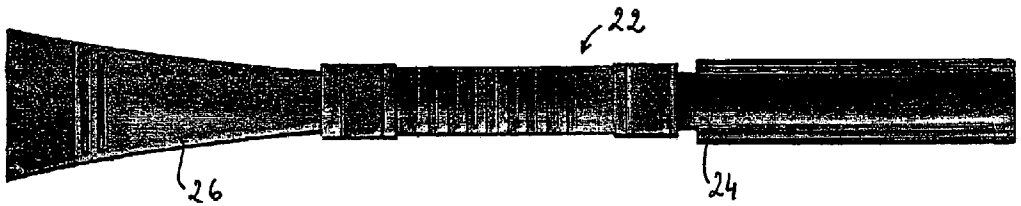
FIG. 4 is a top view of the snow tool of FIG. 3 in a retracted position.

FIGS. 3 and 4 show another snow tool 20 according to the present invention, wherein only the visual design slightly differs from the snow tool shown in FIGS. 1 and 2.

Figure 5:
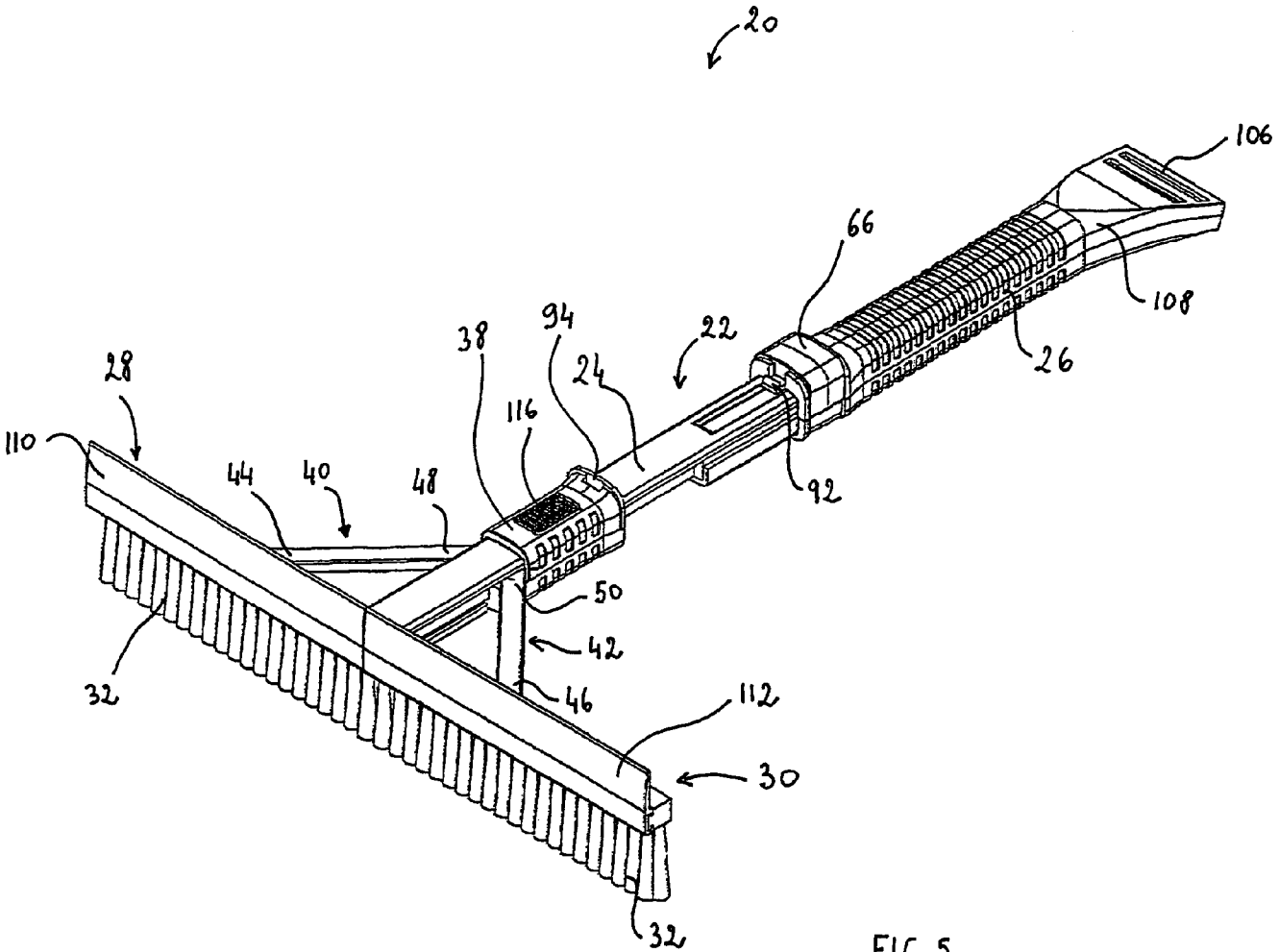
FIG. 5 is a perspective view of another snow tool in an extended position, according to the present invention.
Figure 6:
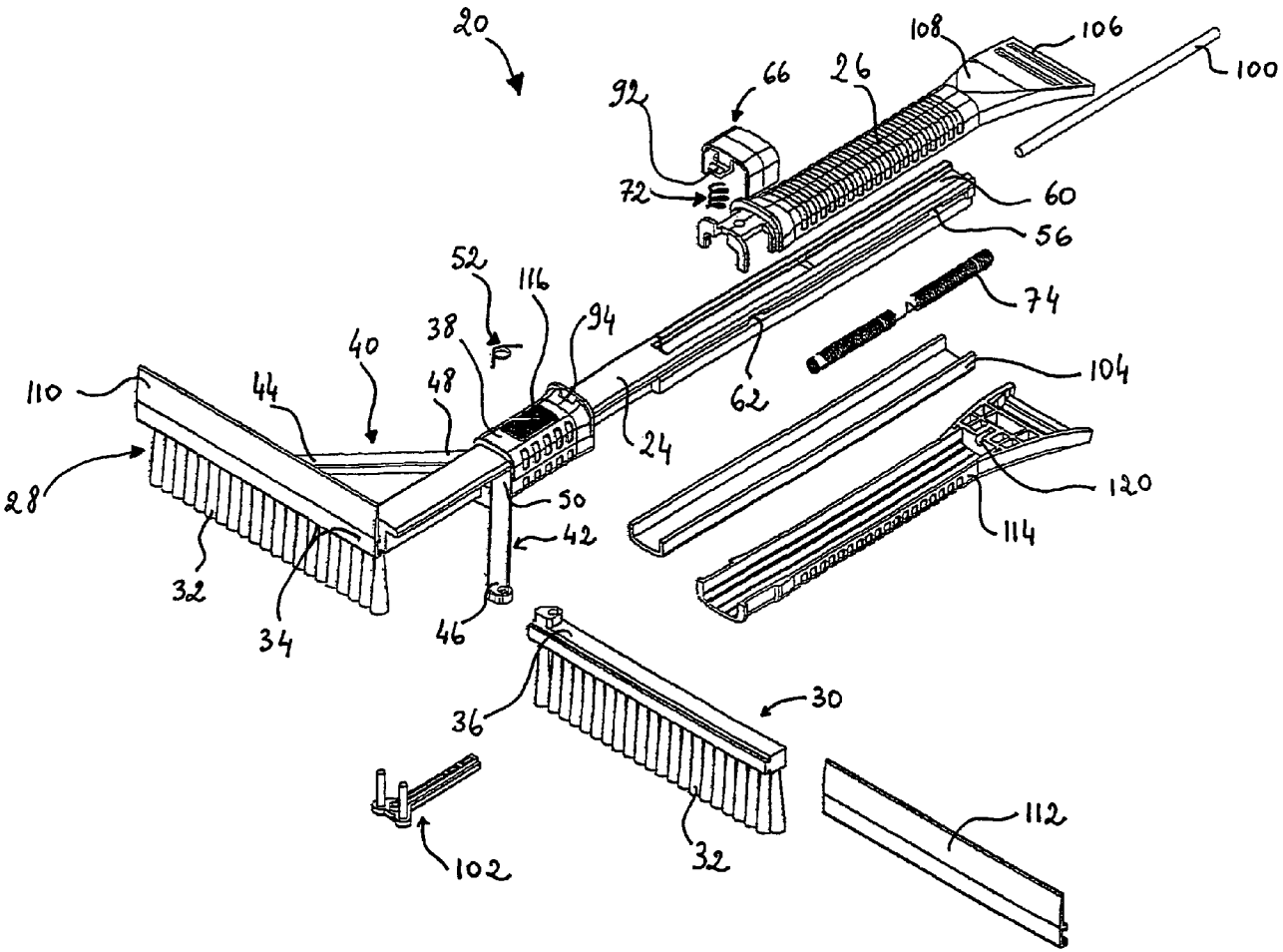
FIG. 6 is a partially exploded perspective view of the snow tool shown in FIG. 5.

Referring now to FIGS. 5 and 6, there is shown another snow tool 20 having a visual design slightly different from the snow tool shown in the preceding Figures. The snow tool 20 includes a pair of arms 28, 30, each having bristles 32 provided along the length thereof. An end 34, 36 of each of the arms 28, 30 is pivotally attached to the first member 24. In a preferred embodiment, a fixing element 102, as illustrated on FIG. 16, can be used for conveniently mounting the arms 28, 30 on the first element 24. The snow tool 20 is also provided with means for moving the arms 28, 30 between a closed position where the arms 28, 30 extend along the handle 22 and an open position where the arms 28, 30 extend transversally to the handle 22. FIG. 1 illustrates a snow tool 20 whose arms 28, 30 extend along the handle 22 while FIG. 2 illustrates the same snow tool 20 with the arms 28, 30 extending transversally to the handle 22.

Figure 7:
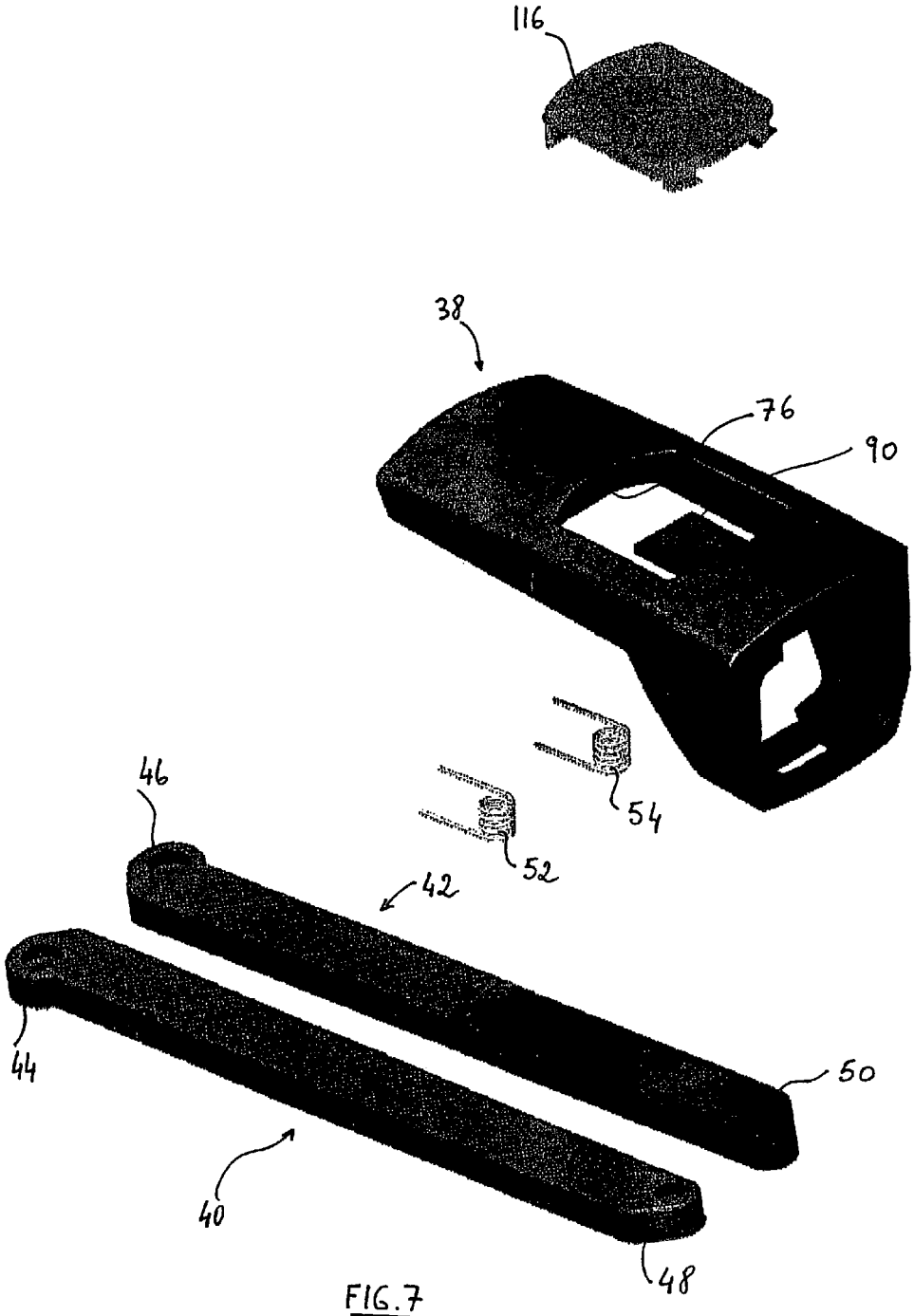
FIG. 7 is an exploded perspective view of a part of the snow tool shown in FIGS. 1 and 2.
Figure 8A:
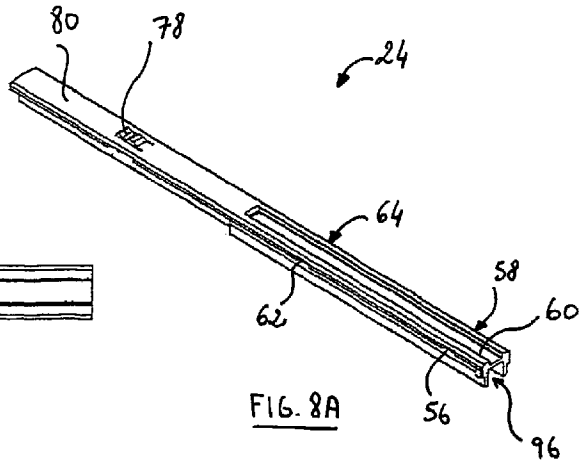
FIG. 8A is a perspective view of the first member of the handle of the snow tool shown in FIG. 5.
Figure 8D:
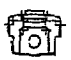
FIG. 8D is a rear view of the first member shown in FIG. 8A.
Figure 8B:
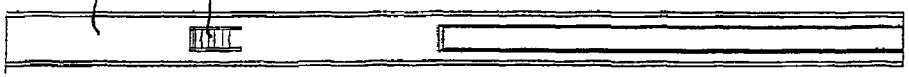
FIG. 8B is a top view of the first member shown in FIG. 8A.
Figure 8C:
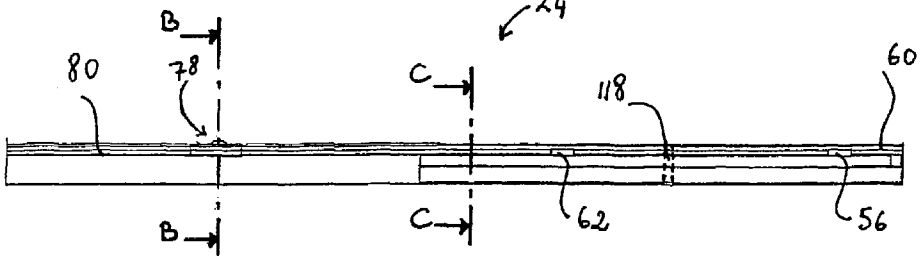
FIG. 8C is a side view of the first member shown in FIG. 8A.
Figure 8E:
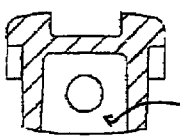
FIG. 8E is a front section view along line C-C of FIG. 8C.
Figure 8F:
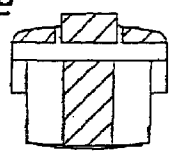
FIG. 8F is a front section view along line B-B of FIG. 8C.

Still referring to FIGS. 5 and 6 and also to FIG. 7, preferably, in a preferred embodiment of the present invention, the means for moving the arms 28, 30 include a collar 38 slidably mounted along the first member 24 of the handle 22 for a longitudinal motion relative to the first member 24. The means for moving the arms 28, 30 also include a pair of struts 40, 42, each having first and second extremities. The first extremities 44, 46 are pivotally mounted on the arms 28, 30 respectively, while the second extremities 48, 50 are pivotally mounted on the collar 38. FIGS. 14 and 15 respectively show a left strut 42 and a right strut 40. The means for moving the arms 28, 30 is also provided with a pair of torsion springs 52, 54 respectively connected to the second extremities 48, 50 of the struts 40, 42 for urging the arms 28, 30 in the open position.

Referring again to FIGS. 5 and 6 and also to FIGS. 8 and 12, the snow tool 20 of the present invention includes first locking means for locking the first and second members 24, 26 with respect to each other in the retracted state. Preferably, in a preferred embodiment, the first locking means include a first pair of recesses 62, 64 provided on both sides of a portion of the first member 24, distal from a rear portion 60 of the first member 24. The first locking means also preferably include a U-shaped element 66 mounted on the second member 26 and having legs 68, 70 capable of cooperating with the first pair of recesses 62, 64. The U-shaped element 66 has a first locked position wherein the legs 68, 70 engage in the first pair of recesses 62, 64 for locking the handle 22 in the retracted state. The U-shaped element 66 also has an unlocked position wherein the legs 68, 70 extend out of the recesses for allowing movement of the first member 24 with respect to the second member 26. In this unlocked position, the legs 68, 70 are able to slide freely along the sides of the first member 24. The first locking means also preferably include a resilient means 72, which is preferably a spring, operatively connected to the U-shaped element 66 for urging the legs 68, 70 towards the side portions of the first member 24, thereby locking the U-shaped element 66 in the first locked position when the legs 68, 70 are aligned with the first pair of recesses 62, 64. A depression of the U-shaped element 66 by the user unlocks the U-shaped element 66.

The snow tool 20 also includes second locking means for locking the first and second members 24, 26 with respect to each other in the extended state. Preferably, in a preferred embodiment, the second locking means include a second pair of recesses 56, 58 provided on both sides of a rear portion 60 of the first member 24. The second locking means also preferably include a U-shaped element 66 mounted on the second member 26 and having legs 68, 70 capable of cooperating with the second pair of recesses 56, 58. The U-shaped element 66 has a second locked position wherein the legs 68, 70 engage in the second pair of recesses 56, 58 for locking the handle 22 in the extended state. The U-shaped element 66 also has an unlocked position wherein the legs 68, 70 extend out of the recesses for allowing movement of the first member 24 with respect to the second member 26. In this unlocked position, the legs 68, 70 are able to slide freely along the sides of the first member 24. The first locking means also preferably include a resilient means 72, which is preferably a spring, operatively connected to the U-shaped element 66 for urging the legs 68, 70 towards the side portions of the first member 24, thereby locking the U-shaped element 66 in the second locked position when the legs 68, 70 are aligned with the second pair of recesses 56, 58. A depression of the U-shaped element 66 by the user unlocks the U-shaped element 66.

In a preferred embodiment, the first and second locking means can be coupled together. In other words, the U-shaped element 66 has first and second positions wherein the legs 68, 70 respectively engage in the first pair of recesses 62, 64 for locking the handle 22 in the retracted state and in the second pair of recesses 56, 58 for locking the handle in the extended state. The resilient means 72, which urge the legs 68, 70 towards the side portions of the first member 24 can thereby lock the U-shaped element 66 in either one of the first and second locked positions when the legs 68, 70 are aligned with one of the pairs of recesses 62, 64 and 56, 58.

Still referring to FIGS. 5 and 6, the snow tool 20 also includes a compression spring 74 for urging the first and second members 24, 26 into the extended state. Thus, when the user depresses the U-shaped element 66 and unlocks it, the compression spring 74 urges the first and second members 24, 26 into the extended state. In this case, the legs 68, 70 of the U-shaped element 66 are then aligned with the second pair of recesses 56, 58. Thus, when the user then releases the U-shaped element 66, the resilient means 72 urge the legs 68, 70 towards the side portions of the first member 24 and the legs 68, 70 of the U-shaped element 66 engage in the second pair of recesses 56, 58, thereby locking the U-shaped element 66 in the second position: The first and second members 24, 26 are then locked in the extended state. When the user depresses again the U-shaped element 66, the legs 68, 70 are released from the second pair of recesses 56, 58 and are then able to slide freely along the sides of the first member 24, thereby allowing to retract the handle 22.

Referring now to FIGS. 8 and 13, and again to FIGS. 5 and 6, the snow tool 20 is also provided with third locking means for locking the arms 28, 30 in the open position. Preferably, the third locking means include an abutting element 76 provided on the collar 38 and a resilient raised stop 78 provided on a front portion 80 of the first member 24, capable of cooperating with the abutting element 76 of the collar 38. The third locking means has a locked position wherein the stop 78 engages with the abutting element 76 for locking the arms 28, 30 in the open position. The third locking means also preferably include a resilient tooth 90 provided on the collar 38 and capable of cooperating with the resilient raised stop 78. A depression of the resilient tooth 90 by the user unlocks the third locking means, thereby allowing to move the arms 28, 30 in the closed position. The third locking means can be provided with a push button 116 cooperating with the tooth 90 for facilitating the use of the snow tool 20. It is to be understood that other convenient means could also be envisaged for locking the arms 28, 30 in the open position. For example, the third locking means may be provided with a recessed area provided on the front portion 80 of the first member 24. In this case, the collar 38 would be provided with a button 116 pivotally mounted thereon and provided with a projecting element extending frontward. The projecting element would have an abutting member provided frontward the projecting element and capable of cooperating with the recessed area of the first member 24. The third locking means would have a locked position wherein the abutting member engages with the recessed area for locking the arms 28, 30 in the open position. In this case, a depression of the button 116 by the user will pivotally operate the projecting element upwardly for disengaging the abutting element of the recessed area, thereby allowing to move the arms 28, 30 in the closed position. Of course, any other convenient means known in the art could also be used and won't be further described therein.

Referring now to FIGS. 5, 6, 12 and 13, the snow tool 20 is also provided with fourth locking means for locking the arms 28, 30 in the closed position. In a preferred embodiment of the present invention, the fourth locking means include a first attaching element 92 provided on the U-shaped element 66 and a second attaching element 94 provided on the collar 38 and capable of cooperating in a lockable relationship with the first attaching element 92 for locking the arms 28, 30 in the closed position. In the illustrated preferred embodiment, the first attaching element 92 is a hook and the second attaching element 94 is an opening able to receive and retain the hook. It is however to be understood that any other attaching elements capable of cooperating together in a lockable relationship could also be envisaged. As explained above, when the user depresses the U-shaped element 66, the element 66 unlocks, thereby allowing the handle 22 to extend in the extended state. Concurrently, the depression of the U-shaped element 66 by the user then unlocks the attaching elements 92, 94.

Figure 9A:
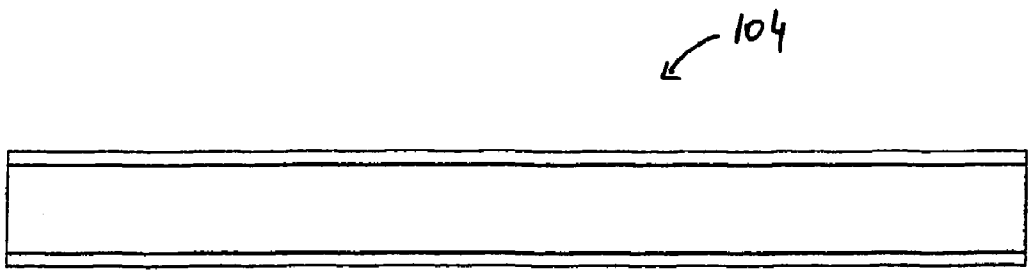
FIG. 9A is a top view of another part of the snow tool shown in FIGS. 5 and 6.
Figure 9B:
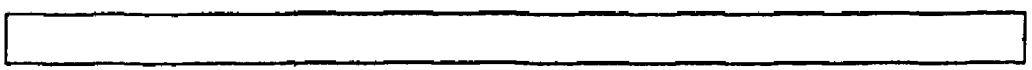
FIG. 9B is a side view of the part shown in FIG. 9A.
Figure 9C:
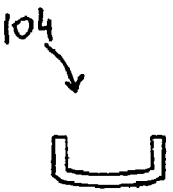
FIG. 9C is a front view of the part shown in FIG. 9A.
Figures 10A, 10B, 10C, 10D, 10E:
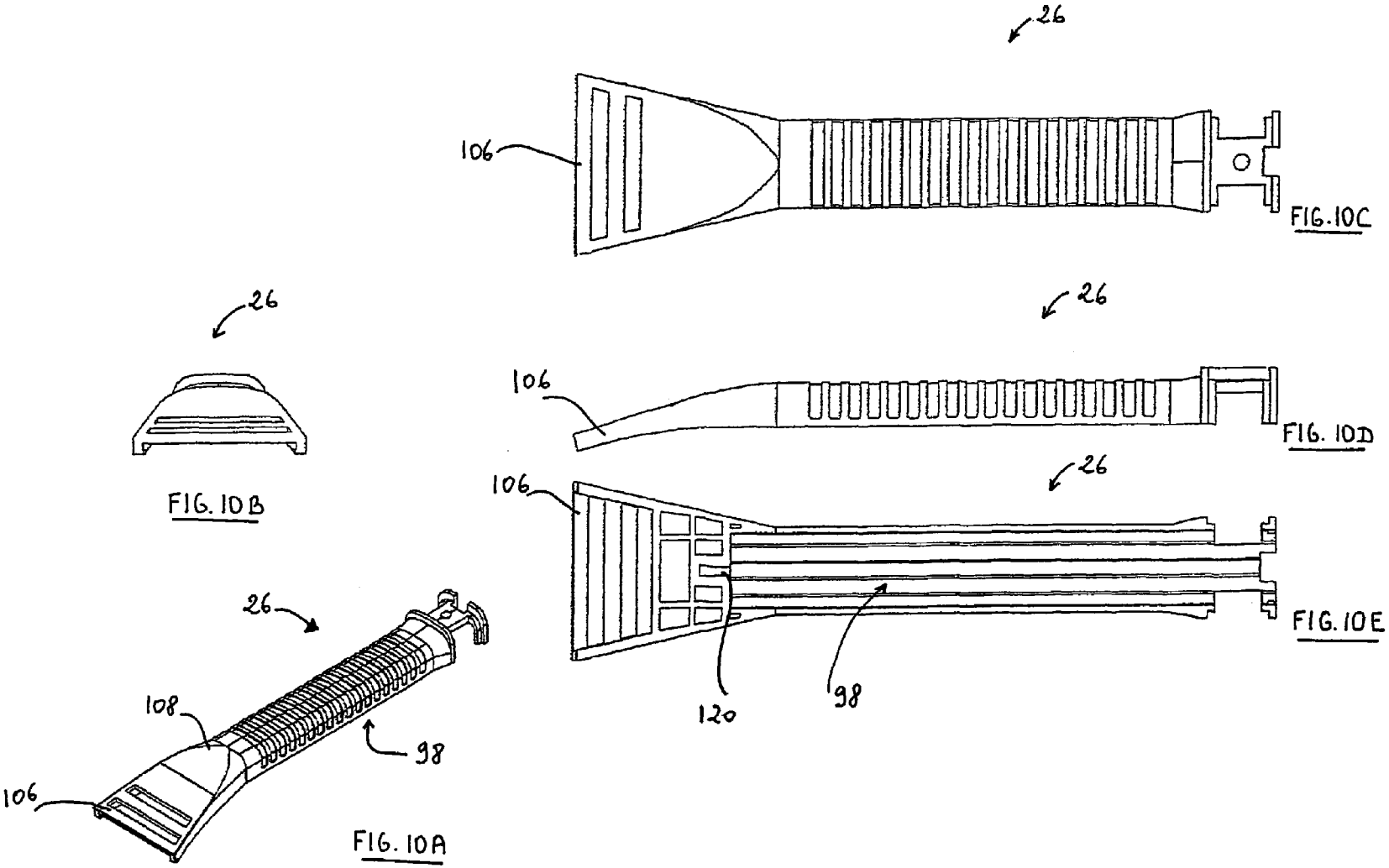
FIG. 10A is a perspective view of another part of the snow tool shown in FIGS. 5 and 6.
FIG. 10B is a front view of the part shown in FIG. 10A.
FIG. 10C is a top view of the part shown in FIG. 10A.
FIG. 10D is a side view of the part shown in FIG. 10A.
FIG. 10E is a bottom view of the part shown in FIG. 10A.
Figure 11C:
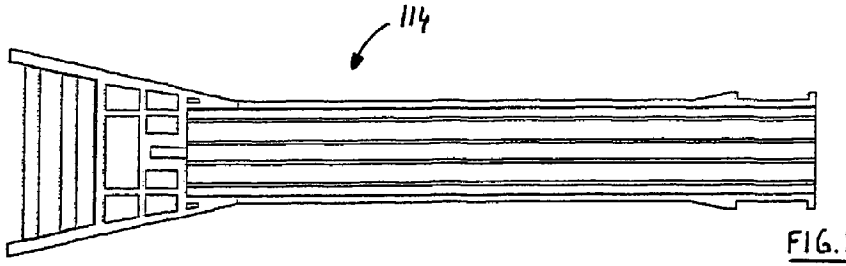
FIG. 11C is a bottom view of the part shown in FIG. 11A.
Figure 11D:
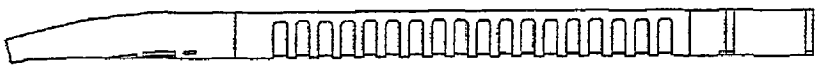
FIG. 11D is a side view of the part shown in FIG. 11A.
Figure 11E:
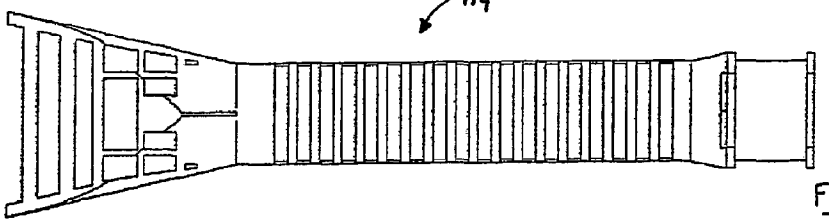
FIG. 11E is a top view of the part shown in FIG. 11A.
Figure 11B:
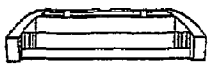
FIG. 11B is a front view of the part shown in FIG. 11A.
Figure 11A:
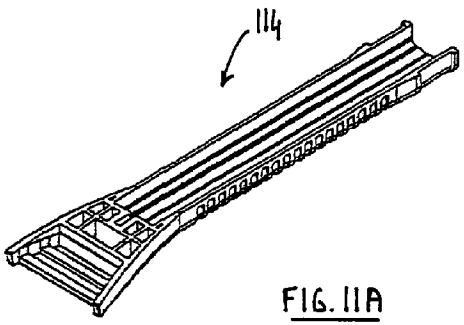
FIG. 11A is a perspective view of another part of the snow tool shown in FIGS. 5 and 6.
Figure 12A:
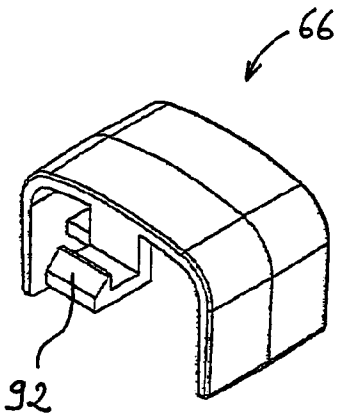
FIG. 12A is a perspective view of another part of the snow tool shown in FIGS. 5 and 6.
Figure 12C:
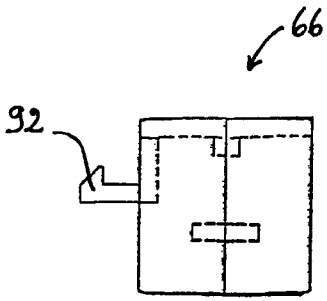
FIG. 12C is a side view of the part shown in FIG. 12A.
Figure 12B:
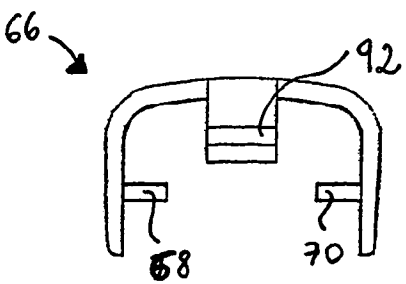
FIG. 12B is a front view of the part shown in FIG. 12A.
Figure 12D:
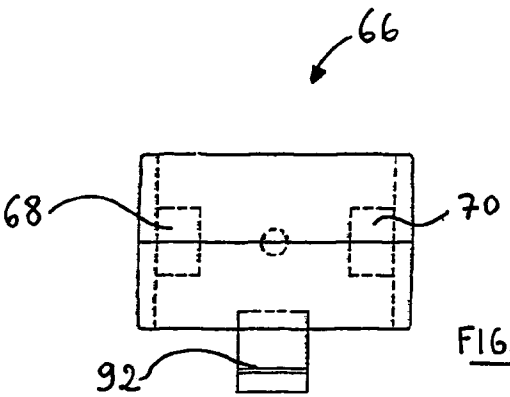
FIG. 12D is a top view of the part shown in FIG. 12A.
Figure 13A:
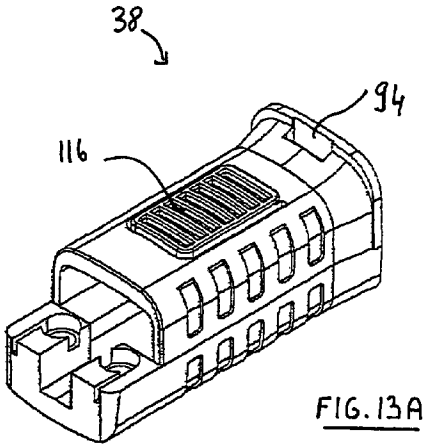
FIG. 13A is a perspective view of another part of the snow tool shown in FIGS. 5 and 6.
Figure 13F:
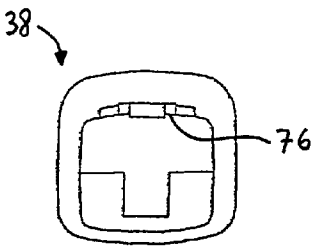
FIG. 13F is a rear view of the part shown in FIG. 13A.
Figure 13B:
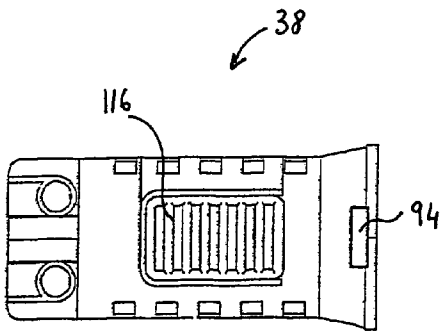
FIG. 13B is a top view of the part shown in FIG. 13A.
Figure 13C:
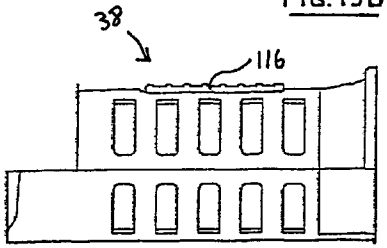
FIG. 13C is a side view of the part shown in FIG. 13A.
Figure 13D:
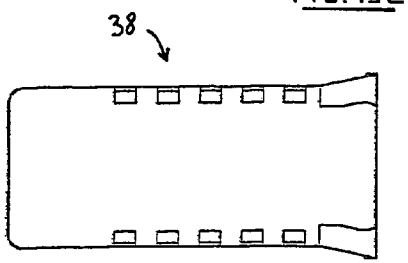
FIG. 13D is a bottom view of the part shown in FIG. 13A.
Figure 13E:
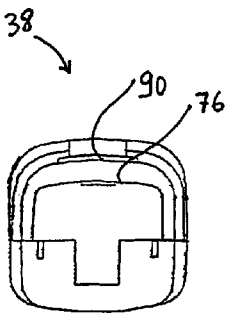
FIG. 13E is a front view of the part shown in FIG. 13A.
Figure 14A:
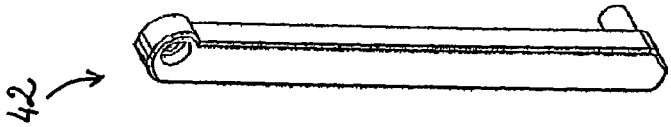
FIG. 14A is a perspective view of another part of the snow tool shown in FIGS. 5 and 6.
Figure 14B:
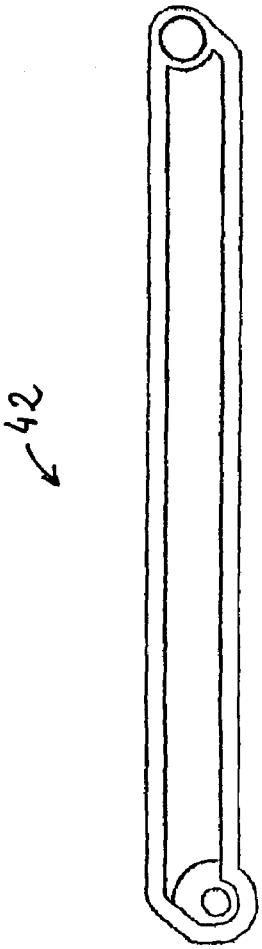
FIG. 14B is a top view of the part shown in FIG. 14A.
Figure 14C:
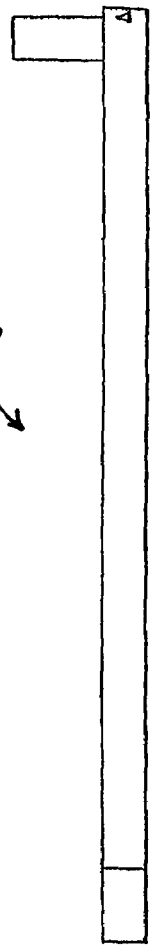
FIG. 14C is a side view of the part shown in FIG. 14A.
Figure 14D:
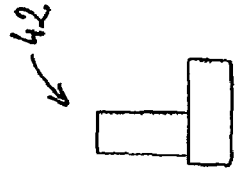
FIG. 14D is a front view of the part shown in FIG. 14A.
Figure 15A:
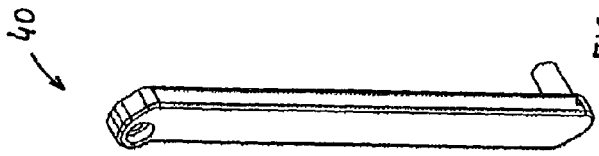
FIG. 15A is a perspective view of another part of the snow tool shown in FIGS. 5 and 6.
Figure 15B:
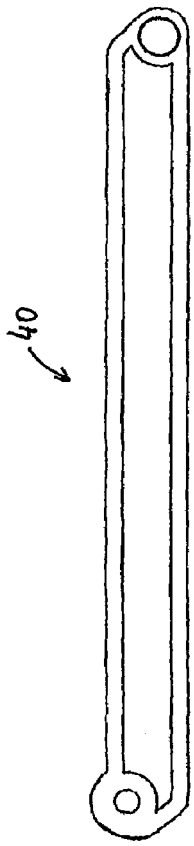
FIG. 15B is a top view of the part shown in FIG. 15A.
Figure 15C:
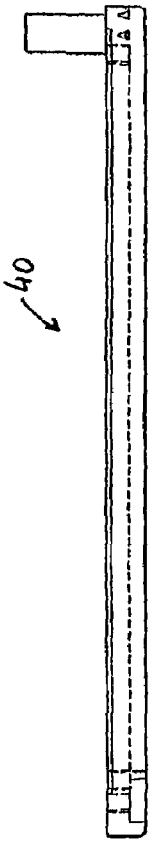
FIG. 15C is a side view of the part shown in FIG. 15A.
Figure 15D:
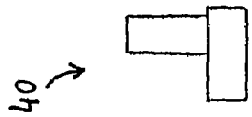
FIG. 15D is a front view of the part shown in FIG. 15A.
Figure 16A:
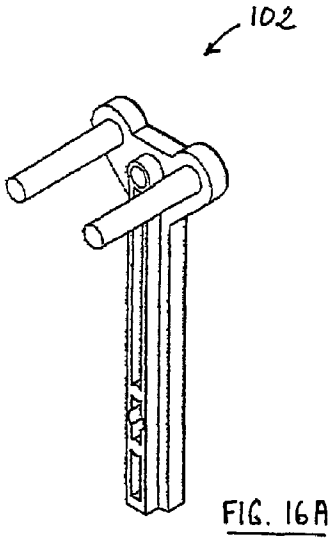
FIG. 16A is a perspective view of another part of the snow tool shown in FIGS. 5 and 6.
Figure 16C:
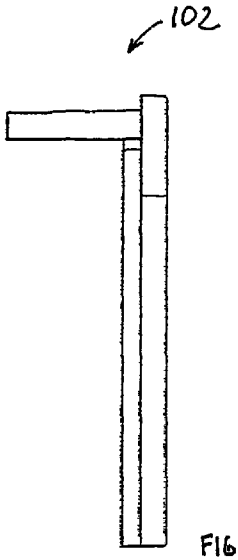
FIG. 16C is a side view of the part shown in FIG. 16A.
Figure 16D:
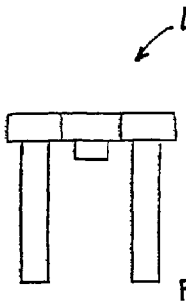
FIG. 16D is a front view of the part shown in FIG. 16A.
Figure 16B:
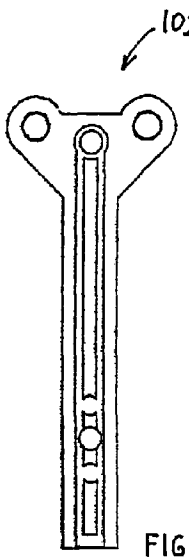
FIG. 16B is a top view of the part shown in FIG. 16A.

Referring now to FIGS. 6, 8 and 10, preferably, the first and second members 24, 26 are each provided with a U-shaped longitudinal recess 96, 98. The U-shaped longitudinal recess 96 of the first member 24 includes an abutting wall 118 extending therein. The snow tool 20 preferably further includes a guiding spring rod 100 extending in the recesses 96, 98 of the first and second members 24, 26 and attached to a point 120 of the second member 26. The guiding spring rod 100 cooperates with the abutting wall 118 for keeping the compression spring 74 in position. In a preferred embodiment, the compression spring 74 can also be associated with a spring cover 104, as illustrated on FIG. 9.

Referring again to FIGS. 5 and 6 and also to FIG. 10, the second member 26 of the snow tool 20 can advantageously be provided with a scraper 106 extending at a free end 108 of the second member 26 for removing ice. Furthermore, the snow tool 20 can also include squeegees 110, 112 mounted respectively on the arms 28, 30, on sides opposite to the bristles 32 to provide an even more convenient tool.

Referring now to FIGS. 6, 10 and 11, the second member 26 can advantageously be provided with a base element 114. Each of the second member 26 and the base element 114 can be provided with a gripping surface providing a better gripping of the snow tool 20 by the user. These two parts and most of the other elements of the snow tool 20 can be made of plastic but other convenient materials such as wood could also be envisaged.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

What is claimed is:

1. A snow tool comprising:

a telescopic handle comprising first and second members connected in a sliding relationship and providing retracted and extended states of the handle;

a pair of arms, each having bristles provided along the length thereof, an end of each arm being pivotally attached to the first member;

means for moving said arms between a closed position where said arms extend along said handle and an open position where said arms extend transversally to said handle;

first locking means for locking the first and second members with respect to each other in the retracted state;

second locking means for locking the first and second members with respect to each other in the extended state;

a compression spring for urging the first and second members into the extended state;

third locking means for locking said arms in the open position; and fourth locking means for locking said arms in the closed position; wherein: said first locking means comprise:

a first pair of recesses provided on both sides of a portion of the first member, distal from a rear portion of the first member;

a U-shaped element mounted on the second member and having legs capable of cooperating with said pair of recesses, said U-shaped element having a first locked position wherein said legs engage in the first pair of recesses for locking the handle in the retracted state, said U-shaped element having an unlocked position wherein said legs extend out of said recesses for allowing movement of the first member with respect to the second member; and a resilient means operatively connected to said U-shaped element for urging said legs towards the side portions of the first member and thereby locking said U-shaped element in said first locked position when said legs are aligned with said first pair of recesses, a depression of said U-shaped element by a user unlocks said U-shaped element;

the means for moving said arms comprise:

a collar slidably mounted along said first member of the handle for a longitudinal motion relative to said first member;

a pair of struts, each having first and second extremities, the first extremities being pivotally mounted on the arms respectively, the second extremities being pivotally mounted on the collar; and at least one torsion element cooperating with the arms for urging the arms in the open position; and said fourth locking means comprise a first attaching element provided on the U-shaped element and a second attaching element provided on the collar and capable of cooperating in a lockable relationship with the first attaching element for locking said arms in the closed position, a depression of said U-shaped element by the user unlocks said attaching elements.

2. The snow tool according to claim 1, wherein the at least one torsion element comprises:

a pair of torsion springs respectively connected to the second extremities of the struts for urging the arms in the open position.

3. The snow tool according to claim 1, wherein said second locking means comprise:

a second pair of recesses provided on both sides of said rear portion of the first member;

a U-shaped element mounted on the second member and having legs capable of cooperating with said pair of recesses, said U-shaped element having a second locked position wherein said legs engage in the second pair of recesses for locking the handle in the extended state, said U-shaped element having an unlocked position wherein said legs extend out of said recesses for allowing movement of the first member with respect to the second member; and a resilient means operatively connected to said U-shaped element for urging said legs towards the side portions of the first member and thereby locking said U-shaped element in said second locked position when said legs are aligned with said second pair of recesses, a depression of said U-shaped element by a user unlocks said U-shaped element.

4. The snow tool according to claim 1, wherein said second locking means comprise a second pair of recesses provided on both sides of said rear portion of the first member, said U-shaped element further having a second locked position wherein said legs engage in the second pair of recesses for locking the handle in the extended state, said resilient means further locking said U-shaped element in said second locked position when said legs are aligned with said second pair of recesses.

5. The snow tool according to claim 1, wherein said resilient means comprise a spring.

6. The snow tool according to claim 1, wherein said third locking means comprise:

an abutting element provided on the collar;

a resilient raised stop provided on a front portion of the first member, capable of cooperating with the abutting element of the collar, said third locking means having a locked position wherein said stop engage with said abutting element for locking the arms in the open position; and a resilient tooth provided on the collar and capable of cooperating with the resilient raised stop by which a depression thereof by a user unlocks said third locking means.

7. The snow tool according to claim 1, wherein said third locking means comprise:

an abutting element provided on the collar;

a resilient raised stop provided on a front portion of the first member, capable of cooperating with the abutting element of the collar, said third locking means having a locked position wherein said stop engage with said abutting element for locking the arms in the open position; and a resilient tooth provided on the collar and capable of cooperating with the resilient raised stop by which a depression thereof by a user unlocks said third locking means.

8. The snow tool according to claim 1, wherein each of the first and second members are each provided with a U-shaped longitudinal recess, said U-shaped longitudinal recess of said first member comprising an abutting wall extending therein, the snow tool comprising a guiding spring rod extending in the recesses of the first and second members and cooperating with said abutting wall for keeping said compression spring in position.

9. The snow tool according to claim 1, wherein the second member is provided with a scraper extending at a free end thereof.

10. The snow tool according to claim 1, further comprising squeegees mounted respectively on said arms, on sides opposite to said bristles.

* * * * *